US005720186A

United States Patent [19]

Brown et al.

[11] Patent Number: 5,720,186

[45] Date of Patent: Feb. 24, 1998

[54] HEAT EXCHANGER

[75] Inventors: Paul Kenneth Brown; James Murel Wheatley, both of Louisville, Ky.

[73] Assignee: General Electric Company, Louisville, Ky.

[21] Appl. No.: 744,046

[22] Filed: Nov. 6, 1996

[51] Int. Cl.[6] ..... F25B 39/02

[52] U.S. Cl. ..... 62/515; 165/146; 165/150; 165/910

[58] Field of Search ..... 62/515, 441; 165/146, 165/150, 910, 182, 183, 184, DIG. 183, 202, 203, 454, 495, 496, 497, 498, 500

[56] References Cited

U.S. PATENT DOCUMENTS

| | | | |
|---|---|---|---|
| 3,080,916 | 3/1963 | Collins | 165/151 |
| 3,678,698 | 7/1972 | Gelbard et al. | 62/276 |
| 4,580,623 | 4/1986 | Smitte et al. | 165/150 |
| 5,067,322 | 11/1991 | Beers | 62/515 |
| 5,157,941 | 10/1992 | Cur et al. | 62/441 |
| 5,183,105 | 2/1993 | Adams | 165/140 |
| 5,193,359 | 3/1993 | Martin et al. | 62/515 |
| 5,205,138 | 4/1993 | Besore et al. | 62/515 |
| 5,214,938 | 6/1993 | Kennedy et al. | 62/515 |
| 5,402,656 | 4/1995 | Jaster et al. | 62/515 |

FOREIGN PATENT DOCUMENTS

| | | | |
|---|---|---|---|
| 822759 | 10/1959 | United Kingdom | 165/910 |

*Primary Examiner*—William Doerrler
*Attorney, Agent, or Firm*—H. Neil Houser

[57] ABSTRACT

A heat exchanger which, in one embodiment, includes an elongate tube having a plurality of straight tube segments and a plurality of bent tube segments to form a generally oval spiral configuration is described. The straight tube segments form opposite sides of the exchanger, and the straight tube segments are configured to be located substantially perpendicular to a direction of air flow. A space is formed between the exchanger opposite sides, and the cross-sectional area of the space between the exchanger opposite sides continuously decreases from a first end of the exchanger to a second end of the exchanger. An end straight tube segment substantially extends over, or substantially covers or closes, an opening between opposing tube segments at the exchanger second end. A plurality of heat exchange fins project outwardly from the elongate tube. Due to its general shape, the above described heat exchanger sometimes is referred to herein as a pyramid exchanger.

20 Claims, 1 Drawing Sheet

Fig. 1
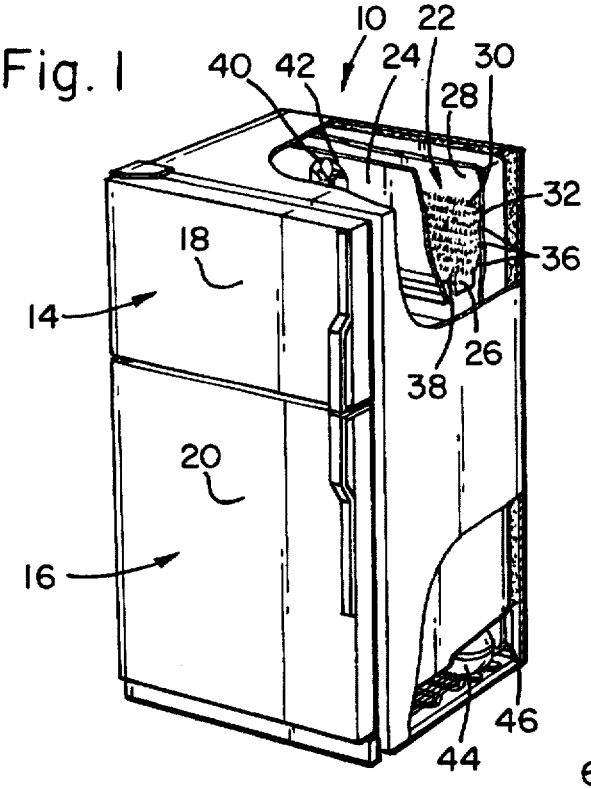
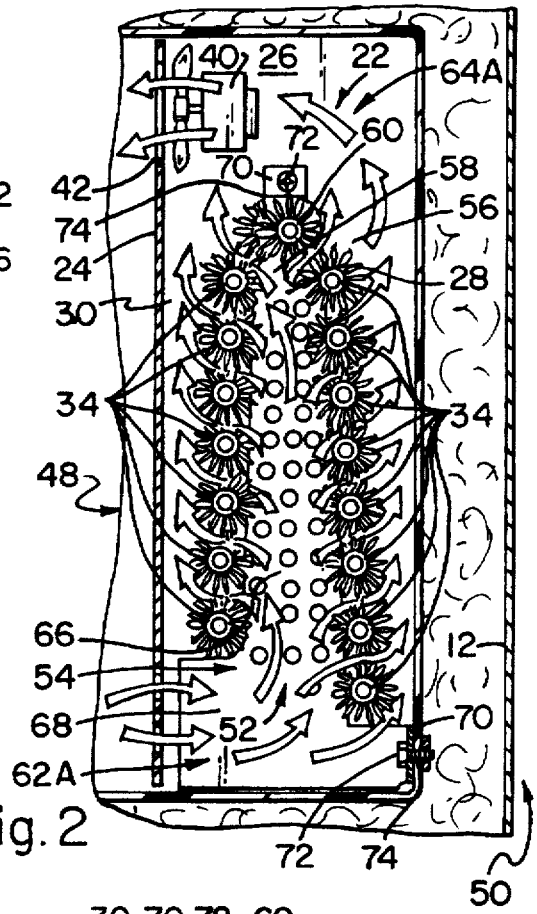
Fig. 2
Fig. 3
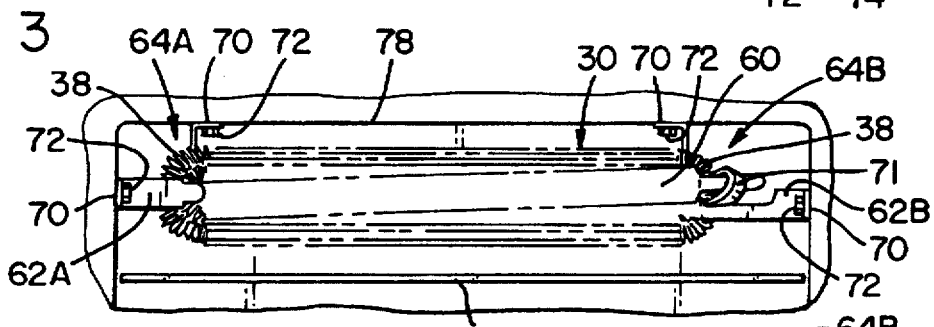
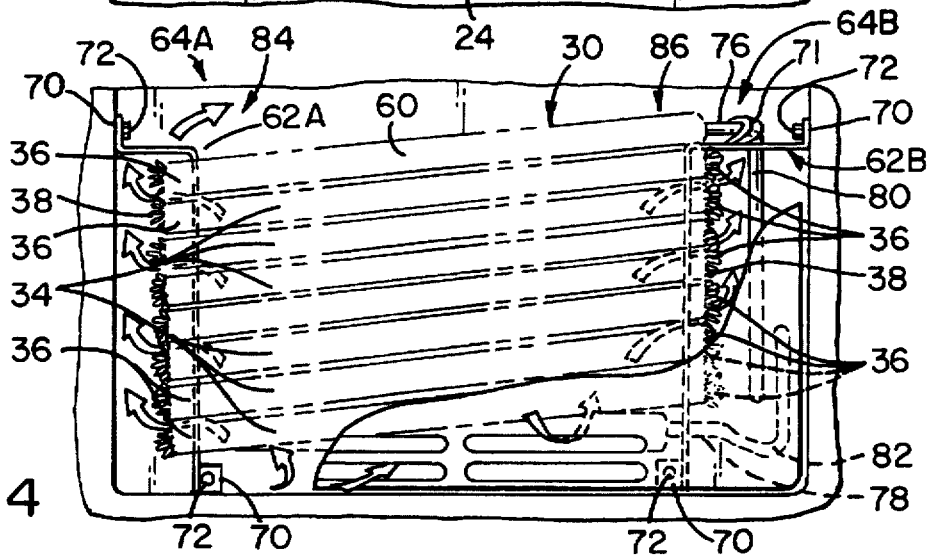
Fig. 4

HEAT EXCHANGER

FIELD OF THE INVENTION

This invention relates generally to heat exchangers and, more particularly, to a spine fin refrigerator evaporator.

BACKGROUND OF THE INVENTION

Household refrigerators generally utilize a simple vapor compression cycle for cooling air. Such a cycle includes a compressor, a condensor, an expansion device, and an evaporator connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator compartments.

The evaporator preferably is compact because it occupies refrigerated space. Any space occupied by the evaporator and its associated components (i.e., fan, defrost heater, ducting, etc.) reduces the space available for food storage space. Further, in operation, condensed moisture forms as frost or ice on the leading side of the evaporator surfaces. Therefore, an effective evaporator must be able to accumulate large amounts of ice without producing substantial air blockage.

Cost also is an important issue with evaporators. Specifically, as the length of tubing required for an evaporator increases, the evaporator cost also increases. More complex the tubing configurations also typically result in higher fabrication costs.

Therefore, for an evaporator, it would be desirable to minimize the amount of tubing required as well as to have a simple tubing configuration. Of course, such a reduced cost evaporator must also satisfy the evaporator operational requirements.

SUMMARY OF THE INVENTION

These and other objects may be attained in a heat exchanger which, in one embodiment, includes an elongate tube having a plurality of straight tube segments and a plurality of bent tube segments to form a generally oval spiral configuration. The straight tube segments form opposite sides of the exchanger, and the straight tube segments are configured to be located substantially perpendicular to a direction of air flow. A space is formed between the exchanger opposite sides, and the cross-sectional area of the space between the exchanger opposite sides continuously decreases from a first end of the exchanger to a second end of the exchanger. An end straight tube segment substantially extends over, and substantially covers or closes, an opening between opposing tube segments at the exchanger second end. A plurality of heat exchange fins project outwardly from the elongate tube. Due to its general shape, the above described heat exchanger sometimes is referred to herein as a pyramid exchanger.

In one application, the above described heat exchanger serves as an evaporator in a refrigerator. Specifically, the refrigerator includes a fresh food compartment and a freezer compartment. An evaporator chamber is located in the freezer compartment, and the evaporator is located in the evaporator chamber. The evaporator is supported in the chamber by brackets and is positioned so that the evaporator first end is first exposed to the flow of air. A fan also is located in the evaporator chamber to cause air to flow generally upwardly through the chamber.

In operation, refrigerant flows through the evaporator from the first end to the second end. The fan draws air upward through the chamber, and also upward through the evaporator. As warm air passes over the cool elongate tube of the evaporator, the air is cooled due to a heat exchange between the cool tube and the warmer air. The cooled air is then blown into the freezer compartment by the fan.

With the above described evaporator, substantially all warm air which flows into the evaporator first end typically undergoes at least one heat exchange with the cool elongate tube. Particularly, by substantially closing off the second end of the evaporator with the end straight tube segment, all air which flows into the first end of the evaporator will not exit from the evaporator without passing through an opening, or gap, between tube segments. As a result, substantially all warm air which enters into the evaporator first end is cooled due to a heat exchange between the tube and air, and very little, if any, warm air is passed into other portions of the freezer compartment from the evaporator chamber. By not injecting substantial amounts of warm air into the other portion of the freezer compartment from the evaporator chamber, the efficiency of the refrigerator is improved.

In addition, air which flows into the evaporator first end typically undergoes only one heat exchange with the evaporator elongate tube. For example, with the above described evaporator, air is not required to weave along a path which results in a plurality of heat exchanges between the air and the evaporator tube before the air completely passes through the evaporator. Rather, with the above described evaporator, the air simply passes through any one gap or opening between tube segments as described above and can then be blown into the other portion of the freezer compartment without any further substantial heat transfer with the evaporator. As a result, with the above described evaporator, the pressure drop between the evaporator compartment inlet and the evaporator compartment outlet is believed to be minimized. Minimizing such pressure drop facilitates use of a smaller, lower energy usage fan to provide the same cooling provided by some known evaporators using larger, higher energy usage fans.

Further, and with respect to frost accumulation, the air flow through the evaporator described above is substantially evenly distributed through the evaporator. Since the air flow is substantially evenly distributed and rather than frost accumulating on the lowermost tube sections, for example, the frost is substantially evenly distributed on the elongate tube surfaces. As a result of such even frost distribution, the heat transfer along the elongate tube sections remains substantially constant for a longer period of time and minimizes the pressure drop between the evaporator chamber inlet and outlet for a longer period of time, which in turn facilitates greater air flow through the evaporator and more efficient cooling.

The above described evaporator also is configured so that the refrigerant flows therethrough in a generally upward direction. Such upward flow is beneficial because it better ensures that the refrigerant will evaporate in the evaporator. That is, liquid refrigerant is less likely to reach the evaporator outlet, i.e., the evaporator second end, than evaporated refrigerant since gravity prohibits the free flow of liquid refrigerant to the evaporator second end. Therefore, with the present evaporator, the possibility of liquid refrigerant reaching the compressor inlet is reduced. In evaporators having a downward flow of refrigerant, it is possible that the liquid refrigerant will simply flow through the evaporator at an increased rate and not evaporate in the evaporator. If liquid refrigerant is delivered to the compressor inlet, such liquid refrigerant could damage the compressor. With the above described evaporator, the possibility of compressor damage due to the presence of liquid refrigerant in the compressor is believed to be reduced.

The above described heat exchanger also provides the advantages of requiring a shorter length of tubing than some known exchangers, thereby reducing the internal refrigerant pressure losses and external air pressure losses. A shorter length of tubing also reduces the material costs as compared to known evaporators. Further, the exchanger is relatively simple to fabricate as compared to known exchangers. Such simple fabrication facilitates reducing the time required to fabricate the exchanger and the exchanger fabrication cost.

BRIEF DESCRIPTION OF THE DRAWINGS

FIG. 1 is a perspective view of a top mount refrigerator with parts cut away.

FIG. 2 is a cross sectional view through the evaporator compartment and evaporator shown in FIG. 1.

FIG. 3 is a top view of the evaporator shown in FIG. 1.

FIG. 4 is a side view of the evaporator shown in FIG. 1.

DETAILED DESCRIPTION OF THE DRAWINGS

FIG. 1 is a perspective view of a top mount refrigerator 10 with parts cut away. Refrigerator 10 includes an outer cabinet 12 containing a freezer compartment 14 and a fresh food compartment 16. Freezer compartment 14 is located over fresh food compartment 16. Doors 18 and 20 close compartments 14 and 16. An evaporator chamber 22 is located in freezer compartment 14, and is formed by a vertically extending front panel 24 separating evaporator chamber 22 from the rest of freezer compartment 14, substantially parallel side walls 26, and an inner rear liner 28. Evaporator chamber 22 fills an entire top-to-bottom portion in the rear of freezer compartment 14. Refrigerator 10 may, for example, be model number TBX18, commercially available from General Electric Company, Appliance Park, Louisville, Ky. 40225, modified to include evaporator 30, which is described below in more detail.

Evaporator 30 is located in evaporator chamber 22, and evaporator 30 includes an elongate tube 32 having a plurality of straight tube segments 34 and a plurality of bent tube segments 36 to form a generally oval spiral configuration. A plurality of heat exchange, or spine, fins 38 project outwardly from elongate tube 32. Spine fins 38 provide a large heat exchange area per unit length of tube 32. Such spine fins 38 are described in more detail in U.S. Pat. No. 5,067,322, which is assigned to the present assignee.

A fan 40 is located in evaporator chamber 32 and is positioned to cause air to flow generally upwardly through evaporator chamber 22. Fan 40 is substantially aligned with an outlet, or opening, 42 in front panel 24 to blow cold air from evaporator chamber 22 into the other portion of freezer compartment 14. More particularly, evaporator 30 is a component of a simple vapor compression cycle for cooling air. A compressor 44 located in a compressor compartment 46, a condensor (not shown), an expansion device (not shown), and evaporator 30 are connected in series and charged with a refrigerant. As described hereinafter in more detail, heat from air passing over evaporator 30 is transferred to refrigerant flowing through evaporator 30, thereby cooling the air and causing the refrigerant in evaporator 30 to vaporize. The cooled air which has passed over evaporator 30 is blown into the other portion of freezer compartment 14 by fan 40.

FIG. 2 is a cross sectional view through evaporator chamber 22 and evaporator 30. As shown in FIG. 2, evaporator straight tube segments 34 form opposite sides 48 and 50 of evaporator 30, and a space 52 is formed between opposite sides 48 and 50. The cross-sectional area of space 52 between opposite sides 48 and 50 substantially continuously decreases from a first end 54 to a second end 56 of evaporator 30. At evaporator second end 56, an uppermost, or end, straight tube segment 60 extends over, or substantially covers or closes, an opening 58 between opposing sides 48 and 50 of evaporator 30. Evaporator 30 sometimes may be referred to as a pyramid evaporator due to its general geometric shape.

Evaporator 30 is supported in chamber 22 by brackets 62A and 62B. Bracket 62A is shown in FIG. 2. Bracket 62A extends between opposite sides 48 and 50 of evaporator 30 at one side end 64A. Bracket 62A includes a tapered portion 66, an enlarged support portion 68, and tabs 70. Screws 72 are inserted through openings 74 in tabs 70 and are in threaded engagement with wall 26 and liner 28 of evaporator chamber 22. The above described support of evaporator 30 in chamber 22 provides that evaporator first end 54 is first exposed to the flow of air in evaporator chamber 22, and straight tube segments 34 are substantially perpendicular to a direction of air flow through evaporator chamber 22.

FIG. 3 is a top view of evaporator 30 shown in FIG. 1. As shown in FIG. 3, bracket 62B is substantially identical to bracket 62A except that bracket 62B includes a tube securing tab 71 which wraps around and secures tube segment 60. Tab 71 provides such securing of tube segment 60 without requiring extra components or support, and is integral with bracket 62B to facilitate reduced costs. Bracket 62B extends between opposite sides 48 and 50 of evaporator 30 at one side end 64B.

FIG. 4 is a side view of evaporator 30 in chamber 22. One side 48 of evaporator 30 is illustrated in FIG. 4, and such view illustrates the flow of air into evaporator 30 and out of evaporator 30 through openings, or gaps, between adjacent tube segments 34 and 36. FIG. 4 also clearly illustrates the spiral configuration of tube 32. As also shown in FIG. 4, ends 76 and 78 of tube 32 are welded to fluid carrying tubes 80 and 82 so that evaporator 30 is in fluid communication with other components of the compression cycle as described above. Both brackets 62A and 62B also are shown in FIG. 4. Brackets 62A and 62B are located at respective opposite side ends 84 and 86 of evaporator 30.

With respect to fabricating evaporator 30, aluminum tubing with spine fins is utilized. Of course, suitable materials other than aluminum tubing could be utilized. Such tubing is well known in the art. In addition, and in connection with fabricating evaporator 30, a rotatable fixture having spaced, frustoconical shaped dies is utilized. The dies are spaced so that the outer peripheries of the dies are spaced at a distance equal to provide the desired width of evaporator 30. The taper angle of the frustoconical shaped dies is selected to equal the desired width and taper of space 52. The dies have grooves therein which have widths about equal to the outer diameter of the tubing. To form evaporator 30, the spine fin tubing is fed onto the dies as the dies rotate. Once a desired length of tubing has been wrapped on the dies, which length is selected to provide the desired height of evaporator 30 when located in evaporator chamber 22, the tubing is removed from the dies. Tube segment 60 is then formed by placing the tubing on a mandrel which supports the tubing so that tube segment 60 can be formed to extend over center plane 58. Brackets 62A and 62B are then inserted into the tubing and shaped, i.e., bent, so that tabs 70 will lie against wall 26 when located in chamber 22. Brackets 62A and 62B are self-aligning since edge portions of brackets are tapered, i.e., tapered portion 66. Tapered portions 60 substantially correspond to the angular, or pyramid like, arrangement of the tubing.

In one exemplary embodiment, evaporator 30 is fabricated using an aluminum tube having a diameter of about 0.375 inches. The dies are selected so that evaporator 30 has a width of about twenty inches, a height of about nine inches, a depth of about three inches, and an angle between planes extending co-planer with respective opposing sides 48 and 50 of about 6.84 degrees. Of course, many other dimensions for evaporator 30 are possible and the above described dimensions are provided by way of example only.

The above described fabrication process is relatively simple as compared to the fabrication processes utilized in connection with known exchangers. Such simple fabrication is believed to facilitate reducing the time required to fabricate the exchanger. In addition, the tooling costs are believed to be low.

In operation, refrigerant flows through evaporator 30 from first end 54 to second end 56. Fan 40 draws air upward through chamber 32, and also upward through evaporator 30. Particularly, air is drawn from evaporator first end 54 towards evaporator second end 56. Due to the upward flow of air in space 52, the air pressure within space 52 may increase sufficiently so that air flows out from space 52 through openings, or gaps, between tube segments 34 and 36. As the air passes through such openings and over the elongate tube of evaporator 30, the air is cooled due to a heat exchange between the cool tube and the warmer air. The cooled air is then blown into the other portion of freezer compartment 14 by fan 40.

With evaporator 30, substantially all air which flows into evaporator first end 54 typically undergoes at least one heat exchange with the evaporator elongate tube. Particularly, by substantially closing off second end 56 of evaporator 30 with end straight tube segment 60, all air which flows into first end 54 will not exit from evaporator 30 without passing over a portion of the tube as described above. As a result, substantially all air which enters into evaporator first end 54 is cooled due to the heat exchange between the tube and air, and very little, if any, warm air is passed into the other portion of freezer compartment 14 from evaporator chamber 22. By not injecting substantial amounts of warm air into freezer compartment 14 from evaporator chamber 22, the efficiency of refrigerator 10 is improved.

In addition, air which flows into evaporator first end 54 typically undergoes a heat exchange with the elongate tube only once. With evaporator 30, the air simply passes through any one opening or gap between tube segments 34 and 36 as described above and can then be blown into the other portion of freezer compartment 14 without any further substantial heat transfer with evaporator 30. As a result, with evaporator 30, the pressure drop between the evaporator chamber inlet and the evaporator chamber outlet is believed to be minimized. Minimizing such pressure drop facilitates use of a smaller, lower energy usage fan to provide the same cooling provided by known evaporators using larger, higher energy usage fans.

Further, and with respect to frost accumulation, the air flow through evaporator 30 is substantially evenly distributed. Since the air flow is substantially evenly distributed and rather than frost accumulating on the lowermost tube sections, for example, the frost is substantially evenly distributed on the elongate tube surfaces. As a result of such even frost distribution, the heat transfer along the elongate tube sections remains substantially constant for a longer period of time and minimizes the pressure drop between the evaporator chamber inlet and outlet for a longer period of time, which in turn facilitates greater air flow through evaporator 30 and more efficient cooling.

Evaporator 30 also is configured so that the refrigerant flows therethrough in a generally upward direction. Such upward flow is beneficial because it better ensures that the refrigerant will evaporate in evaporator 30. That is, liquid refrigerant is less likely to reach evaporator second end 56 than evaporated refrigerant since gravity prohibits the free flow of liquid refrigerant to evaporator second end 56. Therefore, with evaporator 30, the possibility of liquid refrigerant reaching the compressor inlet is reduced, thereby reducing the possibility of compressor damage due to the presence of liquid refrigerant in the compressor. Of course, in some configurations, refrigerant could flow downward from second end 56 to first end 54, and use of evaporator 30 is not limited to the upward flow described above.

Evaporator 30 is relatively short as compared to some known evaporators, thereby reducing the internal refrigerant pressure losses and external air pressure losses. Shorter length evaporator 30 also has reduced material costs as compared to some known evaporators. In addition, since air flow typically undergoes only one heat exchange with evaporator 30, the temperature difference between the air and refrigerant will be greater thereby possibly increasing heat transfer per length of tubing. In addition, evaporator 30 has sufficient surface area to satisfy frost accumulation requirements.

Although a specific use and operation of evaporator 30 has been described herein, it is contemplated that evaporator 30 could be used and operated in alternative configurations. For example, evaporator 30 is described above with evaporator first end 54 being first exposed to the flow of air in evaporator chamber 22. Evaporator 30 could, however, be rotated so that end tube segment 60 is first exposed to the flow of air. In addition, refrigerant could be directed to flow in either direction through evaporator 30.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A refrigerator comprising:

a fresh food compartment;

a freezer compartment;

an evaporator chamber located in said freezer compartment; and an evaporator located in said evaporator chamber, said evaporator having a first end and a second end, and comprising an elongate tube having a plurality of straight tube segments and a plurality of bent tube segments to form a generally oval spiral configuration, said straight tube segments forming opposing sides, an end straight tube segment substantially covering an opening between said opposing sides at said evaporator second end.

2. A refrigerator in accordance with claim 1 wherein said evaporator further comprises a plurality of heat exchange fins projecting outwardly from said elongate tube.

3. A refrigerator in accordance with claim 1 wherein said straight tube segments are substantially perpendicular to a direction of air flow through said evaporator chamber.

4. A refrigerator in accordance with claim 1 wherein a space is located between said evaporator opposing sides.

5. A refrigerator in accordance with claim 4 wherein a cross-sectional area of said space between said opposing sides continuously decreases from said evaporator first end to said evaporator second end.

6. A refrigerator in accordance with claim 5 wherein said evaporator first end is first exposed to the flow of air in said evaporator chamber.

7. A refrigerator in accordance with claim 5 wherein said evaporator second end is first exposed to the flow of air in said evaporator chamber.

8. A refrigerator in accordance with claim 1 wherein said elongate tube is configured so that air flowing through said evaporator undergoes at least one heat exchange with said tube.

9. A refrigerator in accordance with claim 1 further comprising first and second brackets for securing said evaporator to walls of said evaporator chamber, said first bracket extending between opposite sides of said evaporator at one side end thereof, and said second bracket extending through said space between opposite sides of said evaporator at a second side end thereof.

10. A refrigerator in accordance with claim 1 wherein a space is located between said evaporator opposite sides, a cross-sectional area of said space between said opposing sides continuously decreasing from said evaporator first end to said evaporator second end, and said elongate tube is configured so that air flowing through said evaporator undergoes at least one heat exchange with said tube.

11. A refrigerator in accordance with claim 10 further comprising a fan to cause air to flow generally upwardly through said evaporator chamber.

12. A heat exchanger comprising an elongate tube having a plurality of straight tube segments and a plurality of bent tube segments to form a generally oval spiral configuration, said straight tube segments forming opposing sides of said heat exchanger, an end straight tube segment substantially covering an opening between said opposing sides at one end thereof.

13. A heat exchanger in accordance with claim 12 further comprising a plurality of heat exchange fins projecting outwardly from said elongate tube.

14. A heat exchanger in accordance with claim 12 wherein said straight tube segments are configured to be located substantially perpendicular to a direction of air flow.

15. A heat exchanger in accordance with claim 12 wherein a space is located between said opposing sides.

16. A heat exchanger in accordance with claim 15 wherein a cross-sectional area of said space between said opposing sides continuously decreases from a first end of said exchanger to a second end of said exchanger.

17. A heat exchanger in accordance with claim 12 wherein said elongate tube is configured so that air flowing through said exchanger undergoes at least one heat exchange with said tube.

18. A heat exchanger in accordance with claim 12 further comprising first and second brackets for securing said elongate tube to walls of a chamber, said first bracket extending through said space between opposite sides of said tube at one side end thereof, and said second bracket extending through said space between opposite sides of said tube at a second side end thereof.

19. A heat exchanger in accordance with claim 12 wherein a space is located between said opposing sides, a cross-sectional area of said space continuously decreasing from a first end of said exchanger to a second end of said exchanger, and wherein said elongate tube is configured so that air flowing through said exchanger undergoes at least one heat exchange with said tube.

20. A bracket for securing a heat exchanger to a wall, the heat exchanger having an elongate tube forming opposite sides of the exchanger and a space between the exchanger opposite sides, said bracket comprising a tapered portion sized to extend between the exchanger opposite sides at one side end thereof, a taper angle of edges of said tapered portion substantially corresponding to an angular orientation of the opposite sides of the exchanger so that said tapered portion edges engage the opposite sides of the exchanger.

* * * * *